United States Patent [19]

Heiman

[11] 4,287,742

[45] Sep. 8, 1981

[54] MACHINE FOR FORMING CURVED CONDUITS

[76] Inventor: John H. Heiman, 3407 W. Coleman Rd., Kansas City, Mo. 64111

[21] Appl. No.: 72,881

[22] Filed: Sep. 6, 1979

[51] Int. Cl.[3] ..... B21C 37/12

[52] U.S. Cl. ..... 72/49; 72/132; 72/181

[58] Field of Search ..... 29/157 A; 72/49, 50, 72/130, 132, 135, 177, 178, 179, 180, 181, 203; 83/356, 356.1, 356.3, 428; 228/17.7, 145, 146

[56] References Cited

U.S. PATENT DOCUMENTS

| | | | |
|---|---|---|---|
| 449,057 | 3/1891 | Perkins | 83/428 |
| 2,150,731 | 3/1939 | Smith | 72/181 |
| 3,217,402 | 11/1965 | Eckhardt | 228/145 X |
| 3,219,249 | 11/1965 | Fielden | 72/130 |
| 3,282,525 | 11/1966 | Rehr | 83/428 X |
| 3,774,491 | 11/1973 | Killilea | 83/428 X |
| 3,903,723 | 9/1975 | Colbath | 72/181 X |
| 3,914,971 | 10/1975 | Colbath | 72/181 |

FOREIGN PATENT DOCUMENTS

| | | | |
|---|---|---|---|
| 45-35654 | 11/1970 | Japan | 72/203 |
| 190034 | 6/1964 | Sweden | 72/49 |
| 11959 | of 1892 | United Kingdom | 72/49 |
| 642872 | 9/1950 | United Kingdom | 72/50 |
| 830504 | 3/1960 | United Kingdom | 72/50 |

*Primary Examiner*—Ervin M. Combs

*Attorney, Agent, or Firm*—Lowe, Kokjer, Kircher, Wharton & Bowman

[57] ABSTRACT

A machine which forms pipe elbows and other curved conduits by spirally winding a thin strip of sheet metal. The machine includes spaced apart cutting rollers which are reciprocated toward and away from one another by cams in order to cut the strip into a series of interconnected gores having contoured edges. The contoured edges are progressively bent in a manner to interlock by sets of bending rollers that are reciprocated inwardly and outwardly by cams. The strip is spirally wound inside of a ring shaped winding shoe having dies which interlock the opposite edges of the strip. Crimping rollers act to firmly crimp together the interlocked edges to form an acme seam. Clutches permit the cams to be selectively stopped so that the conduit that is formed can be provided with both straight and curved portions.

14 Claims, 13 Drawing Figures

MACHINE FOR FORMING CURVED CONDUITS

BACKGROUND AND SUMMARY OF THE INVENTION

This invention relates in general to the production of curved fittings and deals more particularly with a machine that forms a curved conduit from a continuous strip of sheet metal or another sheet material.

Although machines have been proposed for producing straight conduits by spirally winding a strip of sheet material and joining the adjacent edges, such machines would not be capable of forming curved conduits or fittings such as pipe elbows and the like. In view of the widespread use of curved tapers, offsets, goose necks, elbows and other types of curved conduits and fittiings in the sheet metal industry and related fields, it is apparent that a need exists for a machine that is capable of economically manufacturing such parts from a continuous strip of sheet metal or a similar sheet material. The primary goal of the present invention is to meet that need.

More specifically, it is an object of this invention to provide a machine that operates to form, from a continuous strip of sheet material, spirally wound conduits which are curved in shape.

Another object of the invention is to provide a machine of the character described which is able to form conduits of various sizes, shapes, and curvatures. It is an important feature of the invention in this respect that conduits having compound bends may be produced, as may straight pipes, smoothly curved elbows, goose necks, off-sets, and fittings of virtually any other shape. Further, the machine is readily adjustable as to the diameter and curvature of the conduits that are formed.

Still another object of the invention is to provide, in a machine of the character described, cutting and bending rollers that effectively and reliably cut and form the strip in the desired shape.

A further object of the invention is to provide a machine of the character described that has a drive train which accurately controls the speed of the various operating components relative to one another, while at the same time providing for quick and easy adjustment of the speeds at which the components are driven.

An additional object of the invention is to provide, in a machine of the character described, an arrangement for effectively guiding and securely interlocking the edges of the spirally wound conduit.

In conjunction with the preceding object, it is yet another object of the invention to provide a machine of the character described wherein each side edge of the strip is progressively and gradually bent in a manner to avoid abrupt bends and other stresses which can weaken the sheet material.

A still further object of the invention is to provide a machine of the character described which is constructed simply and economically and which operates reliably with only minimal maintenance requirements.

Other and further objects of the invention, together with the features of novelty appurtenant thereto, will appear in the course of the following description.

DETAILED DESCRIPTION OF THE INVENTION

In the accompanying drawings which form a part of the specification and are to be read in conjunction therewith and in which like reference numerals are used to indicate like parts in the various views.

Figure 1:
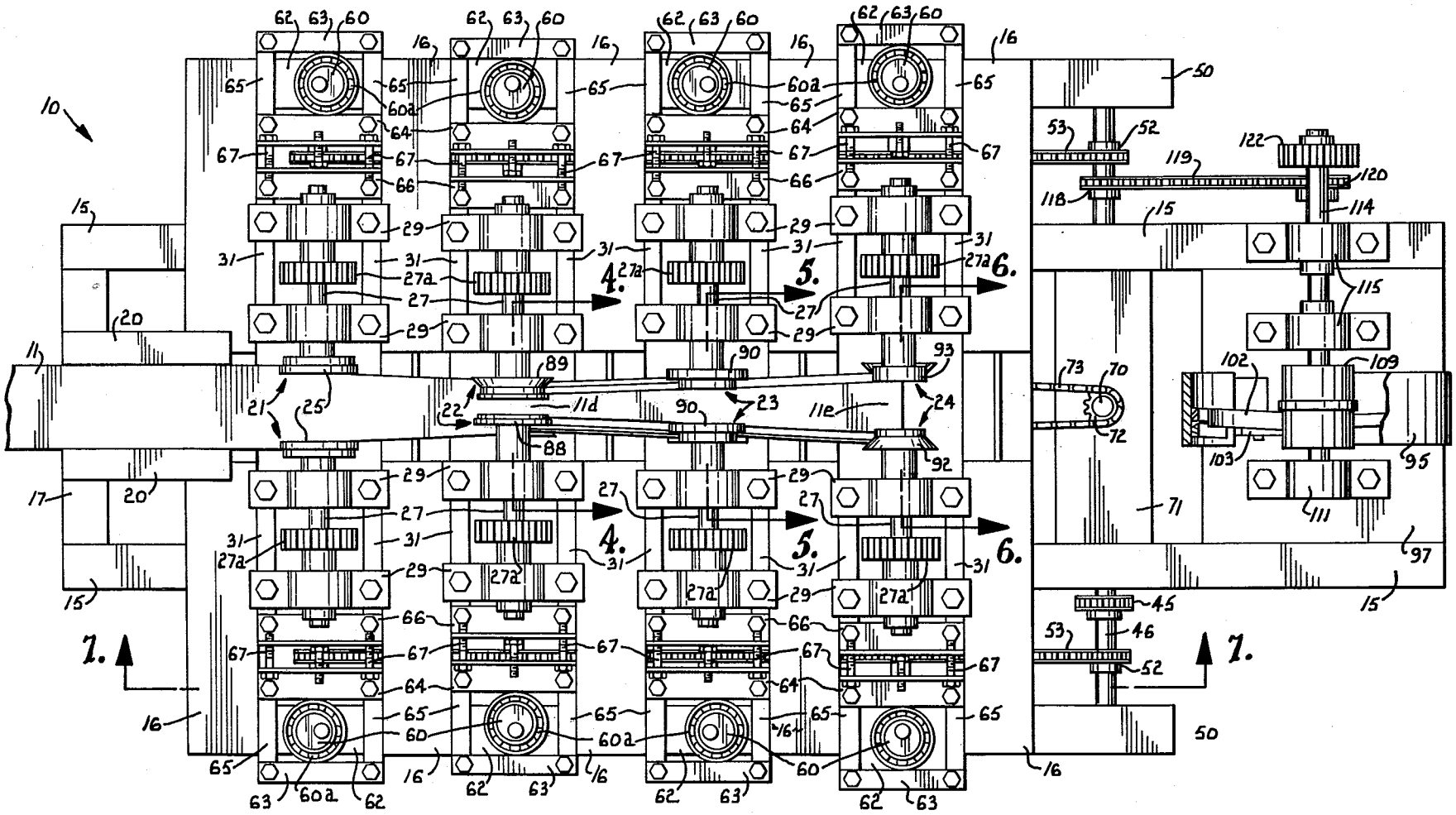
FIG. 1 is a top plan view of a machine which is constructed and arranged to form spirally wound conduits in accordance with the present invention.

Referring now to the drawings in detail, numeral 10 generally designates a machine which is constructed in accordance with the present invention. The machine 10 receives a continuous strip 11 (FIG. 1) of sheet metal or another sheet substance and forms the strip into a spirally wound conduit such as the smoothly curved pipe elbow 12 illustrated in FIG. 13.

Figure 2:
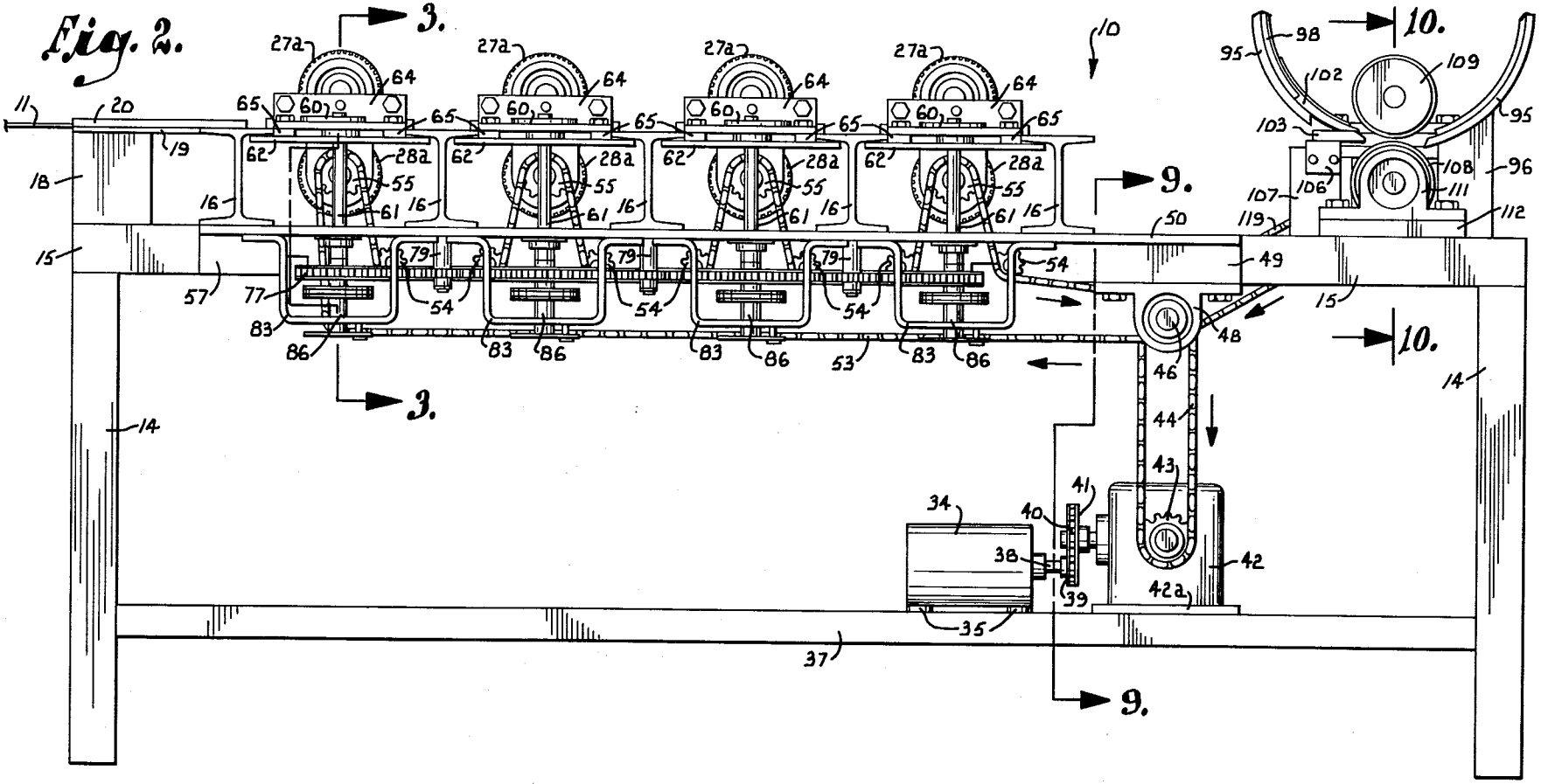
FIG. 2 is a side elevational view of the machine shown in FIG. 1.

Referring particularly to FIGS. 1 and 2, the frame of the machine includes spaced apart legs 14 on top of which a pair of horizontal angles 15 are mounted parallel to one another in extension along the length of the machine. A plurality of uniformly spaced I-beams 16 are mounted on top of the angles 15 and extend parallel to one another across the width of the machine. At the front of the machine, an angle 17 (FIG. 1) is secured in extension between the ends of angles 15. A vertical plate 18 (FIG. 2) extends upwardly from angle 17 at a location midway along the length thereof. A horizontal plate 19 is mounted on top of plate 18 and is also welded to the upper flange of the initial I-beam 16. Strip 11 is received on top of plate 19 and is guided into the machine between a pair of laterally spaced guide bars 20 located on top of the support plate 19 and the initial I-beam 16.

Strip 11 is cut into the proper shape by a pair of cutting devices 21 located on opposite sides of the center line of the machine and each including a pair of cutting rollers located one above the other, as will be explained in more detail. The strip is also engaged by successive pairs of bending devices 22, 23 and 24 each having a pair of bending rollers which act to progressively bend the strip along its side edges in a manner that forms the opposite edges such that they will interlock with one another when the strip is eventually wound in spiral fashion. The mounting of each device 21–24 is essentially the same; therefore, only the cutting mechanism 21 will be described in detail as to the manner in which they are mounted.

Figure 3:
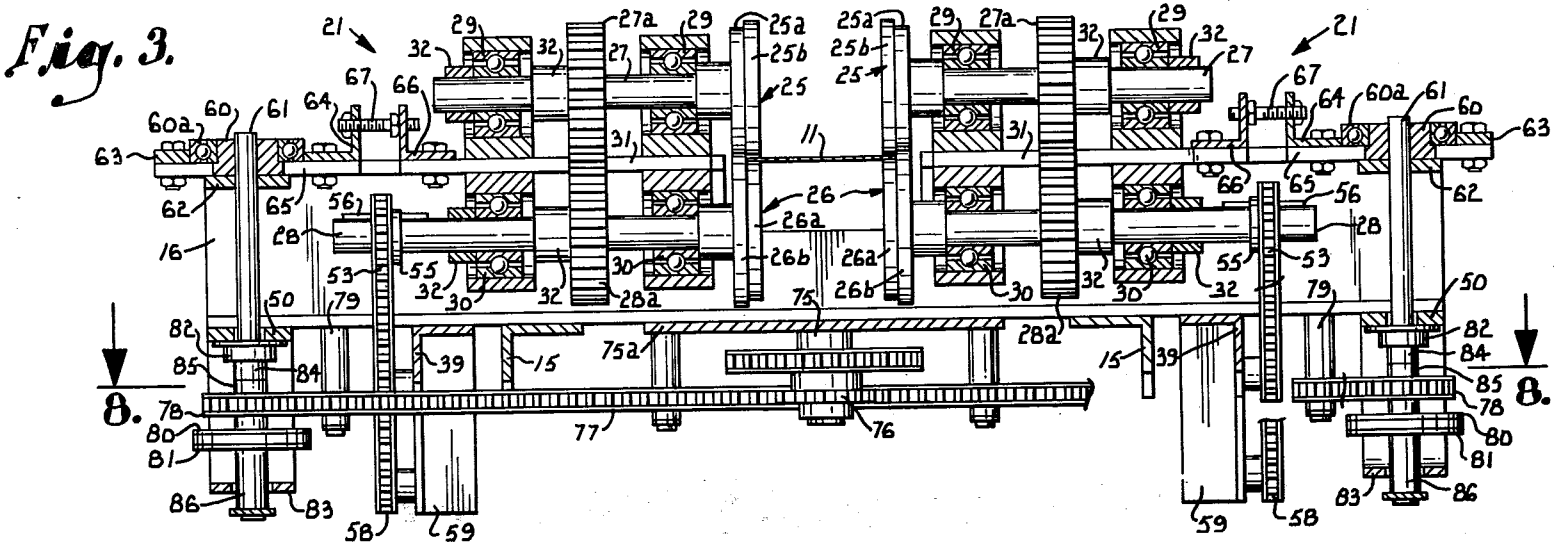
FIG. 3 is a sectional view on an enlarged scale taken generally along line 3—3 of FIG. 2 in the direction of the arrows.

Referring additionally to FIG. 3, each of the cutting devices includes a pair of cutting rollers 25 and 26 arranged one above the other and carried on respective horizontal shafts 27 and 28. The shafts carry meshing gears 27*a* and 28*a*, respectively, which have the same size and pitch in order to rotate the upper shaft 27 at the same speed as the lower shaft 28 but in an opposite direction.

Upper and lower bearings 29 and 30 support the respective shafts 27 and 28 for rotation. The bearings have flanged housings which are bolted to bars 31 which are parallel to one another and located to slide along the edges of the upper flanges of I-beams 16 (see FIG. 1). Shafts 27 and 28 are provided with collars 32 which prevent them from sliding axially with respect to the bearings 29 and 30. The flanged housings of bearings 29 overlap the upper flanges of I-beams 16 as best shown in FIG. 1, while the housings of the lower bearings 30 lie against the bottom surfaces of the upper flanges of the I-beams. The upper flanges of the I-beams 16 thus serve as guideways along which each cutting device is able to slide inwardly and outwardly or toward and away from the centerline of the machine.

Figure 9:
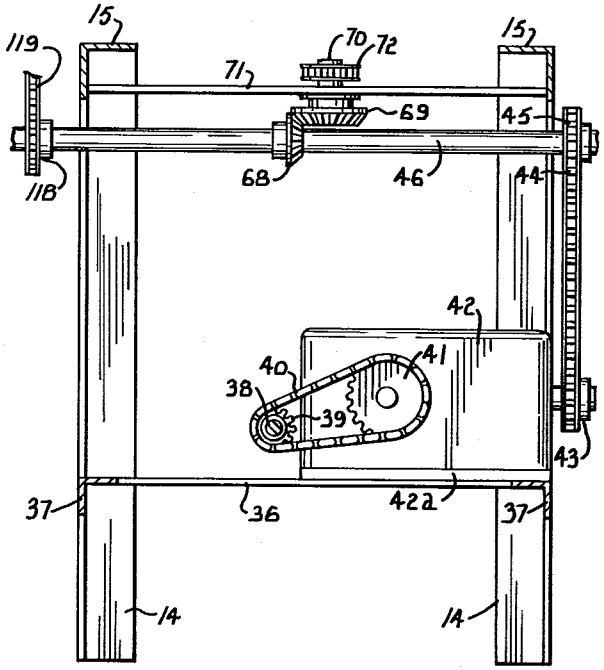
FIG. 9 is a fragmentary sectional view taken generally along line 9—9 of FIG. 2 in the direction of the arrows and showing further details of the drive system.

With reference now to FIGS. 2 and 9 in particular, a conventional electrical motor 34 supplies the power for driving the lower shaft 28 included in each cutting device 21 and each of the bending devices 22–24. Motor 34 is mounted on support bars 35 which are in turn secured to a mounting plate 36 (FIG. 9). The mounting plate 36 extends between angle members 37 that are secured to the frame legs 14 at locations well below the upper angle members 15. Motor 34 drives an output shaft 38 which carries a sprocket 39. A chain 40 is received by sprocket 39 and also by a larger sprocket 41 mounted on a shaft which extends into and drives a gear reducer 42. The gear reducer is mounted on a plate 42*a* secured to plate 36. The output shaft of the gear reducer 42 carries a sprocket 43 which drives a chain 44. The chain 44 is also received by a sprocket 45 carried on a cross shaft 46.

As best shown in FIG. 2, the opposite ends of shaft 46 are supported for rotation by bearings 48 secured to mounting blocks 49. The blocks 49 are mounted to plates 50 which are secured to the bottom of I-beams 16 in extension between the outer ends thereof.

Figure 7:
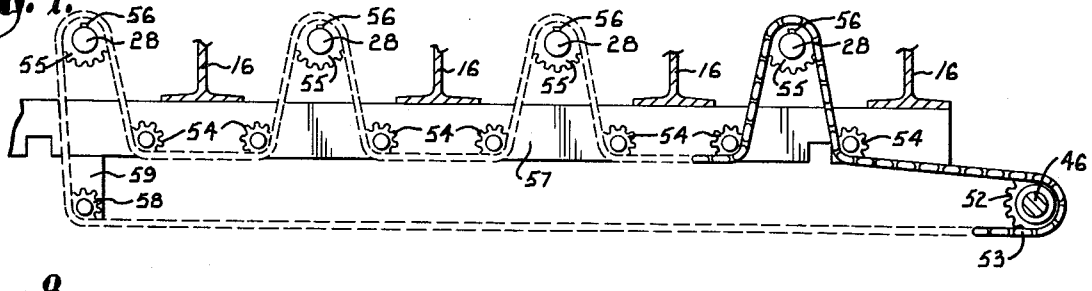
FIG. 7 is a fragmentary sectional view taken generally along line 7—7 of FIG. 1 in the direction of the arrows and showing certain components of the drive system.

Referring now to FIG. 7, shaft 46 carries sprockets 52 near its opposite ends, and the sprockets 52 receive chains 53 which drive the cutting and bending rollers on the opposite sides of the machine. Each chain 53 is drawn around a number of idler sprockets 54 and also around larger sprockets 55 mounted on the respective shafts 28 of the cutting device 21 and the bending devices 22–24. Keys 56 mounts brackets 55 on shafts 28 and permit the shafts to slide axially relative to the sprockets as the cutting and bending units move inwardly and outwardly. The idler sprockets 54 are supported to rotate on angle members 57 which are secured to the I-beams 16. An additional idler sprocket 58 which helps to maintain the tension in chain 53 is mounted to rotate on a frame member 59.

Each of the devices 21–24 has a cam 60 which acts to reciprocate the device inwardly and outwardly. With particular reference to FIGS. 1 and 3, each cam 60 is in the form of a wheel mounted eccentrically on a vertical shaft 61 and provided with a bearing 60*a* which is fitted around the wheel. Each shaft 61 is journaled for rotation on a plate 62 which underlies the cam and extends between adjacent I-beams 16. The outer portion of each bearing 60*a* contacts a bar 63, while the inner side of the bearing acts against an angle member 64. Bar 63 and angle 64 are parallel to one another and are bolted to extend between parallel bars 65 which slide on top of plate 62 along the edges of the upper flanges of I-beams 16.

Each angle member 64 is connected with another angle 66 by a pair of bolts 67 which provide a threaded adjustment by which the distance between the angle members 64 and 66 may be varied. Angles 66 are bolted to the outer ends of bars 31 so that the reciprocating inward and outward movement of angle 64, as effected by the rotation of cam 60, is translated into corresponding movement of angle 66.

Figure 8:
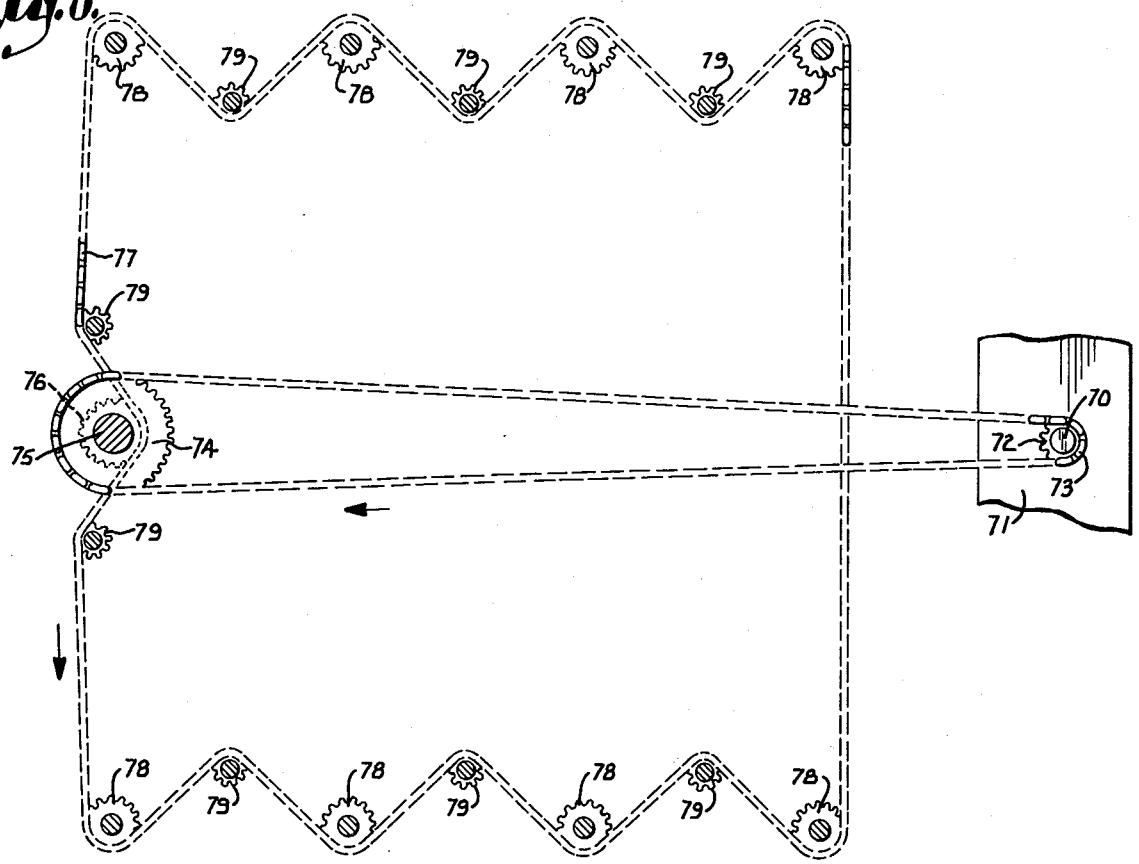
FIG. 8 is a fragmentary sectional view taken generally along line 8—8 of FIG. 3 in the direction of the arrows and showing additional components of the drive system.

Cams 60 are driven by motor 34 through a drive train that correlates the speed at which the cams rotate with the speed at which the cutting and bending rollers rotate, while also permitting the cams to be selectively disengaged from the drive train. With particular reference to FIGS. 8 and 9, a bevel gear 68 carried on the cross shaft 46 mates with and drives another bevel gear 69 mounted on the lower end of a short vertical shaft 70. A plate 71 extending between angle members 15 supports shaft 70 for rotation. Above plate 71, shaft 70 carries a sprocket 72 which drives a chain 73 that is also drawn around a larger sprocket 74. Sprocket 74 is removably mounted on a vertical shaft 75 which also carries a smaller sprocket 76. Shaft 75 is supported by a plate 75*a* (FIG. 3) secured to the frame. A chain 77 is drawn around and driven by sprocket 76. Chain 77 is also received by driven sprockets 78 and by smaller idler sprockets 79 journaled to rotate on the frame.

As shown in FIG. 3, clutch devices having friction plates 80 and 81 selectively connect sprockets 78 with the respective shafts 61 that drive cams 60. Each shaft 61 is supported by a bearing 82 secured to the underside of plate 50 and located within a U-shaped bracket 83 also mounted to the bottom of plate 50. A collar 84 is carried on shaft 61 between bearing 82 and a sleeve 85 which fits loosely on the shaft and carries sprocket 78. Sleeve 85 also carries the upper clutch plate 80 on its lower end. Shaft 61 is able to freely rotate within sleeve 85 when the clutch is disengaged. The lower clutch plate 81 is carried on the top end of the sleeve 86 which is fit on shaft 61 and connected to rotate therewith. Sleeve 86 is mounted such that it is able to slide axially on shaft 61. A spring or the like (not shown) urges sleeve 86 upwardly to normally engage the plates 80 and 81, causing shaft 61 and the connected cam 60 to rotate in response to rotation of sprocket 78. Sleeve 86 extends through the lower bight portion of bracket 83.

The clutches are preferably of the electric or magnetic type in which the plates 80 and 81 may be selectively disengaged by a solenoid or the like (not shown). When the clutch is disengaged, the rotation of sprockets 78 is not transmitted to shafts 61 and the cams 60 are not rotated.

Referring to FIG. 3, each of the upper cutting rollers 25 is in the form of a wheel 25*a* having an enlarged circular flange 25*b* integral with its inside surface. The lower rollers 26 are constructed in the same form but in an opposite arrangement, i.e., a wheel 26*a* of each roller has an enlarged circular flange 26*b* integral with its outwardly side. The peripheries of the upper wheels and flanges move adjacent to the peripheries of the lower flanges and wheels, respectively. As a result, the rollers 25 and 26 cooperate to cut through strip 11 at the locations where the relatively large flanges 25*b* and 26*b* overlap to form sharp cutting edges.

Figure 4:
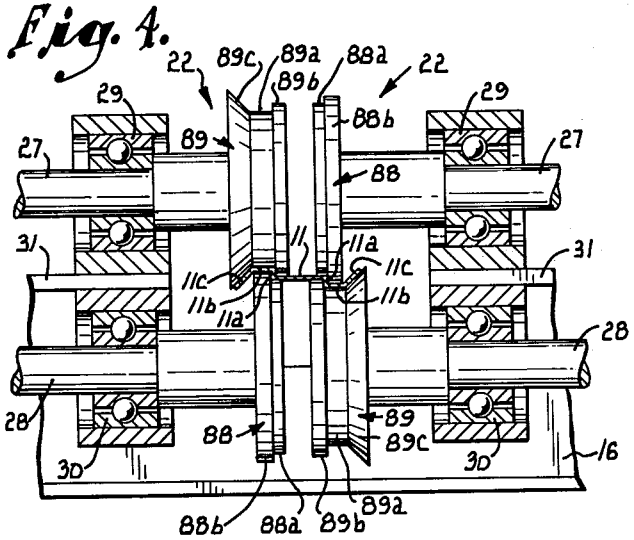
FIG. 4 is a fragmentary sectional view on an enlarged scale taken generally along line 4—4 of FIG. 1 in the direction of the arrows.

The first pair of bending devices 22 are shown in FIG. 4. The device on the right side includes an upper roller 88 carried on the upper shaft 27 of the bending device and a lower roller 89 carried on the lower shaft 28. Roller 88 includes a circular wheel portion 88*a* and a larger disc portion 88*b* located outwardly thereof. The edge of disc portion 88*b* is located closely above the edge of a central wheel portion 89*a* of the lower roller, while wheel 88*a* overlies an enlarged disc portion 89*b* of the lower roller which is located inwardly of wheel portion 89*a*. Roller 89 further includes a beveled flange 89*c* which is located outwardly of the central wheel portion 89*a* and is outwardly flared.

The bending rollers of the device 22 on the left side are identical to those on the right but are reversed as to their locations, i.e., roller 88 is on the bottom and roller 89 is on the top. The sets of rollers 88 and 89 cooperate to act against the side edges of strip 11 in a manner to bend the right edge portion such that it presents a downwardly extending portion 11*a*, an outwardly extending portion 11*b*, and a flange 11*c* which angles outwardly and upwardly due to the beveled shape of flange 89*c*. On the opposite or left edge which is bent oppositely, portion 11*a* extends upwardly, portion 11*b* extends outwardly, and flange 11*c* angles downwardly and outwardly.

Figure 5:
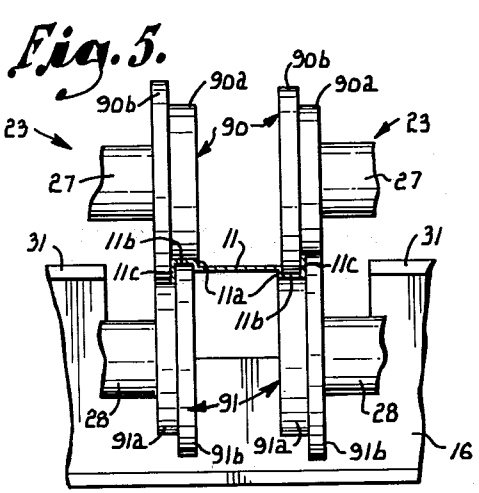
FIG. 5 is a fragmentary sectional view on an enlarged scale taken generally along line 5—5 of FIG. 1 in the direction of the arrows.

Referring now to FIG. 5, each bending device 23 includes an upper roller 90 and a lower roller 91. Each upper roller includes a wheel 90*a* and a larger circular flange 90*b*. The flange 90*b* of each upper roller overlies a wheel portion 91*b* of the corresponding lower roller 91, while each wheel 90*a* overlies an enlarged circular flange 91*b* of the lower roller. The right upper roller has its flange 90*b* on the inside of wheel 90*a*, while flange 90*b* of the left upper roller is outside of the wheel portion. On the lower rollers, the flanges 91*b* are respectively outside of and inside of the right and left wheels 91*a*. Due to the shape and arrangement of rollers 90 and 91, the flanges 11*c* of strip 11 are bent between flanges 90*b* and 91*b* such that the right flange 11*c* extends straight upwardly and the left flange 11*c* extends downwardly after the strip has passed through the second set of bending units 23.

Figure 6:
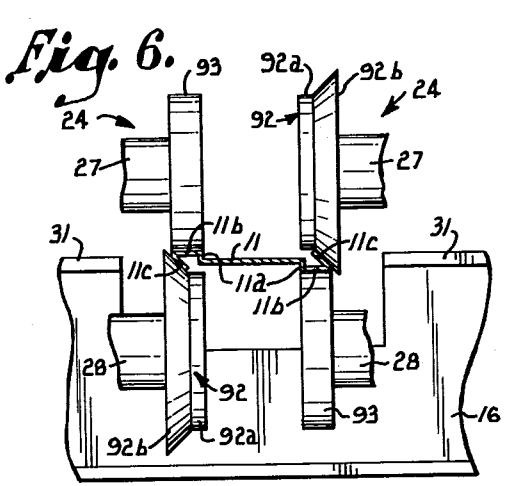
FIG. 6 is a fragmentary sectional view on an enlarged scale taken generally along line 6—6 of FIG. 1 in the direction of the arrows.

FIG. 6 illustrates the configuration of the rollers 92 and 93 included in each bending device 24. The right upper roller 92 includes a wheel portion 92*a* integral with an outwardly flared flange 92*b*. The right lower roller 93 is in the form of a wheel. The rollers on the left side are shaped the same but are arranged oppositely, with roller 92 on the bottom and roller 93 on the top. When strip 11 passes between rollers 92 and 93, its flanges 11*c* are bent inwardly by the flared flanges 92*b* such that the right flange 11*c* angles inwardly and upwardly while the left flange 11*c* angles inwardly and downwardly.

Figure 10:
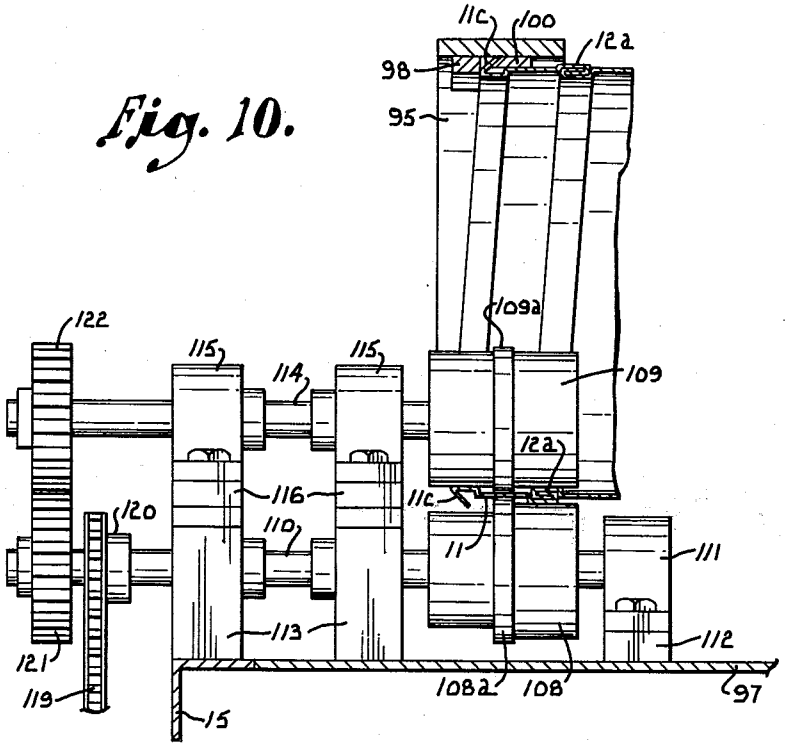
FIG. 10 is a fragmentary sectional view on an enlarged scale taken generally along line 10—10 of FIG. 2 in the direction of the arrows.

Strip 11 is spirally wound by a winding shoe 95 in the form of a curved ring member having its opposite ends spaced apart to present a gap at the bottom of the shoe for receiving the strip. Shoe 95 is mounted on a vertical plate 96 (FIG. 2) which is in turn supported on a horizontal plate 97 (FIG. 1) extending between angles 15. The strip is wound around the inside surface of the shoe and is guided in a spiral path by a guide bar 98 secured to the inside surface of the shoe. As best shown in FIG. 10, bar 98 contacts the corner area where portion 11*b* and flange 11*c* meet. The guide bar 98 is arranged to a spiral configuration so that it guides the edge of strip 11 in a spiral path to meet the opposite edge after it advances around the inside of the shoe 95.

Another bar 100 cooperates with bar 98 in guiding strip 11. Bar 100 is secured to the inside surface of the shoe as a location spaced to one side of bar 98. Bar 100 has a beveled edge portion (see FIG. 10) which receives the flange 11*c* on one edge of the strip in a manner to maintain the flange in its bent condition against the forces which tend to straighten it out as the strip is spirally wound.

Figure 11:
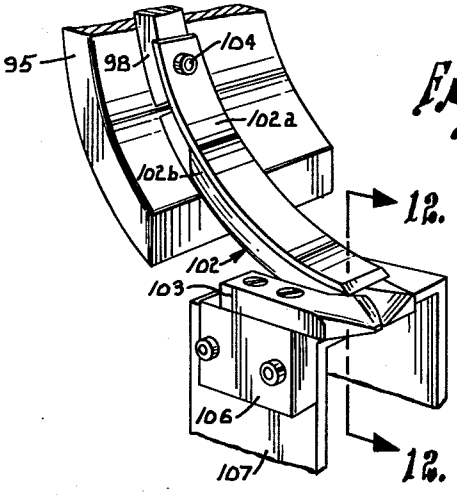
FIG. 11 is a fragmentary perspective view showing the guiding dies which act to interlock the edges of the metal strip from which the conduit is formed.
Figure 12:
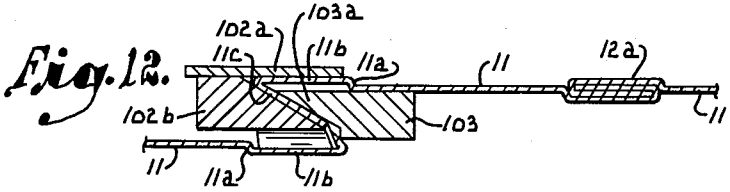
FIG. 12 is a fragmentary sectional view on an enlarged scale taken generally along line 12—12 of FIG. 11 in the direction of the arrows.

The opposite edges of strip 11 are brought together and interlocked by specially shaped dies 102 and 103. With particular reference to FIGS. 11 and 12, die 102 has a curved plate portion 102*a* which is screwed at 104 to the lower end of bar 98. Underlying the plate portion 102*a* is a bar portion 102*b* of the die which recesses gradually inwardly in beveled fashion as it extends downwardly away from bar 98. The beveled recessed area of bar 102*b* is shaped to accommodate and guide the flange 11*c* of the part of the strip moving along the shoe, as best shown in FIG. 12. Die 102 extends well beyond the end of the shoe 95.

The other die 103 is mounted to the top of a block 106 which is in turn secured to the side of a bracket 107 supported on plate 97. As best shown in FIG. 12, die 103 has a beveled portion 103*a* which extends inwardly at a position elevated above the top of bracket 107 and which is spaced a short distance to the side of bar portion 102*b*. Portions 102*b* and 103*a* are beveled oppositely so that the shapes of the die portions are complementary with a space presented between them for accommodating and interlocking the flanges 11*c* on opposite edges of strip 11.

The web of the portion of strip 11 entering shoe 95 moves below die 102 with the flange 11*c* on one of its edges moving between the beveled die portions 102*b* and 103*a*. The portion of strip 11 which has passed around shoe 95 is guided in a manner whereby its web passes above die 103 and its flange 11*c* passes between die portions 102*b* and 103*a* below the opposite flange 11*c*. The flanges 11*c* on opposite edges of strip 11 are thereby interlocked. In addition, dies 102 and 103 cooperate to bend flanges 11*c* to a greater extent that they were previously bent by the final set of bending rollers 92 and 93.

The interlocked flanges 11*c* are crimped together by a pair of crimping rollers 108 and 109. With reference to FIG. 10 in particular, the lower roller 108 is mounted below the gap in shoe 95 on a horizontal shaft 110 which is supported at one end by a bearing 11. The bearing 111 is mounted on a block 112 secured to plate 97. On the other side of the shoe, a pair of spaced apart bearings 113 are secured to plate 97 to rotatably support shaft 110.

The upper roller 109 is mounted on the end of a horizontal shaft 114 located above and parallel to shaft 110 and supported for rotation by a pair of bearings 115. The upper bearings 115 are bolted to the corresponding lower bearings 113. Spacers 116 are interposed between the upper and lower bearings to locate the upper shaft 114 at the proper elevation with respect to the lower shaft 110.

The lower shaft 110 is driven by the electric motor 34. As best shown in FIG. 1, a sprocket 118 mounted on the cross-shaft 46 receives a chain 119 which is also drawn around a sprocket 120 mounted on shaft 110. Meshing gears 121 and 122 (FIG. 10) are mounted on shafts 110 and 114, respectively, to drive the upper crimping roller 109 at the same speed as the lower roller 108 and in an opposite direction.

Figure 13:
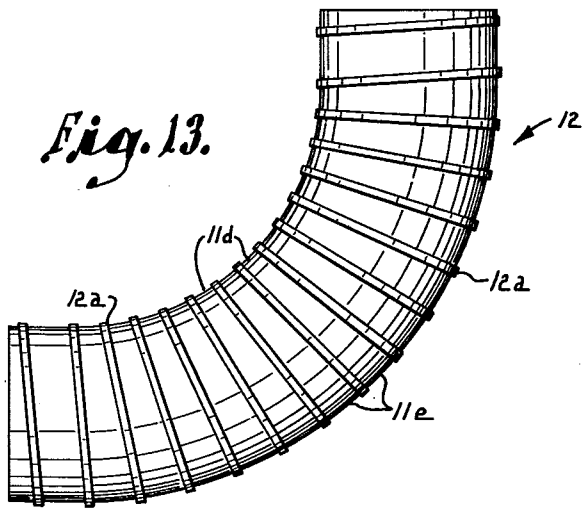
FIG. 13 is a plan view showing a curved pipe elbow of the type that may be formed by the machine.

The upper crimping roller 109 is cylindrical and has a raised rim 109*a* formed on its central portion. The lower roller 108 also has a raised central rim 108*b* but is smaller in diameter on one side of the rim than on the other side. As viewed in FIG. 10, the right portion of roller 108 is the same diameter as roller 109 but the left portion is smaller so as to accommodate free passage between the rollers of the left flange 11*c* of the portion of strip 11 entering shoe 95. The right portions of rollers 108 and 109 are spaced slightly apart such that they act to firmly crimp together the interlocked flanges 11*c* on the opposite edges of the strip. This crimping action secures the strip in its spirally wound shape and forms a continuous acme-type seam 12*a* which spirals continuously around the curved conduit 12, as best shown in FIG. 13. The rims 108*a* and 109*a* engage the opposite surfaces of the strip to assist in advancing it through the machine.

In operation, the leading end of the sheet metal strip 11 is fed into the machine between the guide bars 20 and between the cutting rollers 25 and 26 which are rotated at uniform speed by the electric motor 34. The friction of rollers 25 and 26 against the top and bottom surfaces of the strip advances it along the machine, in cooperation with the friction applied by the bending and crimping rollers located downstream of the cutting rollers.

The cutting action of rollers 25 and 26, accompanied by the reciprocating inward and outward movement of the rollers effected by cams 60, results in the opposite edges of the strip being cut in a curved pattern to form a series of interconnected gores having narrow and wide portions which are indicated respectively at 11*d* and 11*e* in FIG. 1. The narrow portions 11*d* are formed when the long eccentrics of the cams for rollers 25 and 26 point directly toward the centerline of the machine to position the cutting rollers at their minimum spacing. Conversely, the rollers are at their maximum spacing to form the wide portions 11*e* when the short eccentrics of cams 60 point toward the centerline of the machine. Between the wide and narrow portions, the opposite edges of strip 11 are contoured in curved fashion due to the movement of rollers 25 and 26.

After being cut in this pattern, strip 11 encounters the first set of bending devices 22 which are reciprocated inwardly and outwardly by their cams 60 in a path that enables them to follow the contours of the opposite side edges of the strip. Rollers 88 and 89 act to bend the opposite edges of strip 11 into the shape shown in FIG. 4. The strip subsequently encounters bending devices 23 and 24 whose rollers are reciprocated inwardly and outwardly by cams 60 such that they are able to follow the contoured edges of the strip. As a result, the edges of strip 11 are progressively bent into the shapes shown in FIGS. 5 and 6. The progressive bending of the edges avoids any abrupt bends that might cause excessive stress that could weaken or tear the sheet metal.

The cams 60 in each pair are 180° out of phase on opposite sides of the machine. Consequently, and since the cams are driven in the same direction by chain 77, the devices 21–24 on opposite sides of the machine move at the same speed but in opposite directions toward and away from one another. It is also pointed out that each pair of cams 60 is out of phase with respect to the next pair due to the spacing between the devices.

After being cut and having its edges bent in the manner described, strip 11 is advanced into shoe 95. As the strip enters the shoe, one edge passes freely between the crimping rollers 108 and 109 without its flanges 11*c* being engaged by the rollers. The opposite flange 11*c* passes between the crimping portions of rollers 108 and 109 and is thereby flattened. After the strip has passed around the inside surface of shoe 95 in a spiral path, the free flange 11*c* is guided between dies 102 and 103 such that it interlocks with the opposite flange 11*c* on the portion of the strip that is just moving into the shoe. After leaving the dies, the interlocked flanges 11*c* move between the crimping portions of rollers 108 and 109 and are thereby firmly crimped together to form the acme seam 12*a*. As the strip is wound, successive narrow portions 11*d* are brought adjacent to one another and successive wide portions 11*e* are likewise arranged adjacent to one another. Consequently, the elbow 12 that is formed is smoothly curved. As the strip continues to advance through the machine, it is eventually formed in this manner into the curved elbow 12 which can be of any desired length.

By selectively engaging and disengaging the clutch plates 80 and 81, cams 60 can be intermittently driven and stopped so that the edges of the strip 11 are contoured at certain portions and straight at other portions. In this fashion, a spirally wound conduit can be made to have both straight portions and curved portions. For example, by appropriately engaging and disengaging the clutches such that strip 11 are contoured at the beginning or end, the curved elbow 12 can be provided with straight opposite end portions as shown in FIG. 13. Similarly, straight pipes having curved offsets or goosenecks can be formed, as can conduits and fittings of virtually any other configuration.

It is noted that the drive arrangement correlates the speed of rotation of cams 60 with that of the bending and cutting rollers, which in turn determines the speed at which strip 11 advances. The ratio of the large removable sprocket 74 to sprockets 55 determines the distance that strip 11 is advanced longitudinally for each complete revolution of the cams 60. This is the length of each gore. The sprocket ratio can be easily varied by removing sprocket 74 and replacing it with a sprocket having a different size, thereby changing the length of the gores and providing an elbow 12 having a different diameter. For each elbow diameter there is a corresponding winding shoe which can be installed on the machine to handle the conduit which is being formed. The curvature of the elbow may also be varied by changing the eccentricity of cams 60 to adjust the distance that the cutting and bending rollers move inwardly and outwardly.

It is thus apparent that the machine is able to form fittings and conduits of virtually any size, shape, and curvature. Although the acme-type seam is preferred, the opposite edges of the strip may be secured in a variety of other fashions such as by butt or lap joints, by welded seams, or in any other suitable manner.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described my invention, I claim:

1. A machine for forming a curved conduit from a continuous strip of sheet material, said machine comprising:

a frame;

means for advancing said strip along said frame in a preselected path;

a cutting mechanism mounted on said frame at a location along said path, said cutting mechanism including cutters movable toward and away from one another in directions transverse to said path and operable to cut said strip in a manner to form contoured opposite side edges thereof which are shaped to abut one another and provide a conduit having an arcuate axis when said strip is spirally wound;

winding means located downstream of said cutting mechanism along said path for spirally winding said strip in a manner to position the opposite side edges thereof adjacent one another; and means for securing the adjacent side edges of said strip to one another, thereby securing said strip in the shape of a curved spirally wrapped conduit.

2. The invention set forth in claim 1, wherein said cutters comprise:

a pair of spaced apart cutting elements mounted on said frame for movement toward and away from one another and having means thereon for cutting through the strip; and means for selectively moving said cutting elements toward and away from one another to vary the spacing therebetween as said strip advances along said path.

3. The invention set forth in claim 1, wherein said cutting mechanism includes:

a pair of spaced apart cutting elements mounted on said frame for movement toward and away from one another and having means thereon for cutting through the strip; and cam means for reciprocating said cutting elements toward and away from one another as said strip advances along said path.

4. The invention set forth in claim 1, wherein said cutting mechanism includes:

a pair of spaced apart cutting elements mounted on said frame for movement toward and away from one another and having means thereon for cutting through the strip; and a cam mounted on said frame for eccentric movement and operable to move said cutting elements toward and away from one another in response to eccentric movement of said cam; and means for driving said cam at a speed related to the speed of advancement of said strip along said path.

5. The invention set forth in claim 4, including means for adjustably varying the speed of said cam relative to the speed of advancement of said strip along said path.

6. The invention set forth in claim 1, wherein said cutting mechanism includes:

a pair of spaced apart cutting rollers mounted on said frame for rotation and for movement toward and away from one another;

means on each cutting roller for cutting through the strip; and means for moving said cutting rollers toward and away from one another as the strip advances along said path.

7. The invention set forth in claim 6, including:

at least one pair of bending rollers mounted on said frame for rotation and for movement toward and away from one another, said bending rollers being disposted along said path downstream of said cutting rollers;

means for moving said bending rollers toward and away from one another in a manner to substantially follow the contours of the opposite edges of said strip; and means on said bending rollers for bending the edges of said strip in a manner to form a bent portion on each edge shaped to interlock with a cooperating bent portion of the opposite edge.

8. The invention set forth in claim 7, including means for selectively stopping the reciprocating movement of said cutting rollers and bending rollers to thereby form substantially straight portions on the opposite side edges of said strip which are adapted to abut one another to provide a substantially straight segment of the conduit when said strip is spirally wound.

9. The invention set forth in claim 7, including means for crimping said bent edge portions together to provide a spiral seam along which the opposite edges of said strip are secured together.

10. The invention set forth in claim 1, wherein said winding means includes:

a ring member mounted on said frame at a location downstream of said cutting mechanism and along said path, said ring member being arranged to receive said strip and to wind the same in spiral fashion; and guide means associated with said ring member for guiding the opposite edges of said strip adjacent one another.

11. The invention set forth in claim 10, including means for crimping the adjacent edges of said strip together.

12. Apparatus for forming a curved conduit from a continuous strip of sheet material, said apparatus comprising:

a frame;

means for advancing said strip along said frame in a preselected path;

a pair of spaced apart cutting rollers mounted on said frame for rotation and for movement toward and away from one another, said cutting rollers being disposed along said path and being adapted to cut said strip to form opposite side edges thereof;

drive means for rotating said cutting rollers;

means for reciprocating said cutting rollers toward and away from one another as said strip is advanced along said path, said cutting rollers thereby forming contoured side edges of said strip which are adapted to abut one another to provide a curved conduit when said strip is spirally wound;

at least one pair of bending rollers mounted on said frame for rotation and for movement toward and away from one another, said bending rollers being disposed along said path downstream of said cutting rollers and being adapted to bend the opposite side edges of said strip in a manner to form a bent portion on each edge shaped to interlock with a cooperating bent portion of the opposite edge;

means for reciprocating said bending rollers toward and away from one another at a speed to substantially follow the contours the opposite side edges of said strip;

means for spirally winding said strip with the bent portions of said opposite edges interlocking; and means for securing the interlocked opposite edges together, thereby securing said strip in the shape of a curved conduit.

13. Apparatus as set forth in claim 12, wherein said reciprocating means for said cutting and bending rollers includes:

a cam associated with each roller and operable to effect reciprocation of said rollers in response to movement of said cams; and means for effecting movement of said cams at a rate related to the speed at which said strip is advanced along said path.

14. Apparatus as set forth in claim 12, including means for selectively stopping the reciprocating movement of said cutting rollers and bending rollers to thereby form substantially straight portions on the opposite side edges of said strip which are adapted to abut one another to provide a substantially straight segment of the conduit when said strip is spirally wound.

* * * * *